US007255427B2

(12) United States Patent
Mataki

(10) Patent No.: US 7,255,427 B2
(45) Date of Patent: Aug. 14, 2007

(54) LIQUID EJECTION DEVICE AND IMAGE FORMING APPARATUS

(75) Inventor: Hiroshi Mataki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 360 days.

(21) Appl. No.: 11/060,776

(22) Filed: Feb. 18, 2005

(65) Prior Publication Data

US 2005/0179736 A1 Aug. 18, 2005

(30) Foreign Application Priority Data

Feb. 18, 2004 (JP) ..... 2004-041350

(51) Int. Cl.
*B41J 29/38* (2006.01)
*B41J 29/393* (2006.01)
*B41J 2/06* (2006.01)
*B41J 2/05* (2006.01)

(52) U.S. Cl. ..... 347/67; 347/12; 347/13; 347/17; 347/55; 347/19

(58) Field of Classification Search ..... 347/67
See application file for complete search history.

(56) References Cited

U.S. PATENT DOCUMENTS 4,768,045 A * 8/1988 Koto ..... 347/19
6,733,100 B1 5/2004 Fujita et al.

FOREIGN PATENT DOCUMENTS

JP 2-235758 A 9/1990
JP 11-108708 * 4/1999
JP 11-108708 A 4/1999
JP 2001-63008 A 3/2001
JP 2001-315318 A 11/2001
JP 2002-200753 A 7/2002

* cited by examiner

*Primary Examiner*—Julian D. Huffman
(74) *Attorney, Agent, or Firm*—Birch, Stewart, Kolasch & Birch, LLP

(57) ABSTRACT

The liquid ejection device comprises: an ejection head including a plurality of nozzles which eject droplets of liquid onto an ejection receiving medium; a liquid flow speed determining device which determines a flow speed of the liquid in each of the nozzles, the liquid flow speed determining device being arranged in each of the nozzles; an ejection abnormality detecting device which detects an ejection abnormality in each of the nozzles according to the flow speed of the liquid determined by the liquid flow speed determining device; an ejection direction deflecting device which deflects a direction of ejection of a droplet of the liquid ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the liquid ejected from one of the nozzles adjacent to the abnormal nozzle, by means of the ejection direction deflecting device.

16 Claims, 12 Drawing Sheets

LIQUID EJECTION DEVICE AND IMAGE FORMING APPARATUS

BACKGROUND OF THE INVENTION

1. Field of the Invention

The present invention relates to a liquid ejection device and an image forming apparatus, and more specifically to an ejection abnormality compensation technology for detecting and compensating ejection abnormalities in the nozzles of an ejection head.

2. Description of the Related Art

In recent years, inkjet printers have come to be used widely as data output apparatuses for outputting images, documents, or the like. By driving recording elements, such as nozzles, provided in a recording head in accordance with data, an inkjet printer is able to form data onto a recording medium, such as recording paper by means of ink ejected from the nozzles.

An inkjet printer forms an image on recording paper by causing a recording head having a plurality of nozzles and a recording medium to move relatively to each other, while causing ink droplets to be ejected from the nozzles. If an ejection abnormality occurs for some reason in a portion of these nozzles, then a fault occurs in the resulting image, thereby causing image quality to decline. Therefore, it is necessary to take countermeasures.

Conventional methods for detecting ejection abnormalities at nozzles include a method in which a test pattern or an actual image is printed and ejection abnormalities are detected from the resulting image, and a method in which the ejection characteristics are measured inside the recording head. Furthermore, if an ejection abnormality is detected by one of these methods, then droplet ejection control is implemented in order to prevent image faults, for instance, compensatory ejection is performed in such a manner that larger dots than normal are formed by adjacent nozzles in place of the nozzle having an ejection abnormality, or compensatory ejection is performed by driving complementary nozzles, if the recording head is provided with complementary nozzles.

Japanese Patent Application Publication No. 2001-63008 discloses a recording apparatus, control method for same and computer-readable memory, in which data on defective recording elements is stored, complementary elements are chosen according to the data thus stored, and recording is performed by the complementary elements chosen in the defective elements stead.

Japanese Patent Application Publication No. 2001-315318 discloses an inkjet recording apparatus and inkjet recording method, in which non-ejecting nozzles are detected and the amounts ejected from nozzles adjacent to the non-ejecting nozzles are adjusted.

However, in a method where print results, such as a test pattern or an actual image, are determined, it is necessary to eject ink onto the recording medium, and hence recording medium and ink are consumed wastefully for the purpose of determination. Moreover, in a method where physical properties are measured inside the recording head, although it is possible to accurately identify nozzles having an ejection abnormality, it is difficult to determine the extent of the ejection abnormality.

Moreover, if complementary nozzles are provided, then space for installing these complementary nozzles is required, and hence there is a problem in that the head becomes large in size.

The recording apparatus and control method for same described in Japanese Patent Application Publication No. 2001-63008 requires recording actually to be performed in order to identify defective recording elements, and hence it does not resolve the problem of recording media and ink being used wastefully. Furthermore, in order to identify recording elements which become defective over the passage of time, it is necessary to identify defective recording elements periodically and to register these defective recording elements.

Moreover, in the inkjet recording apparatus and the inkjet recording method according to Japanese Patent Application Publication No. 2001-315318, since a defective nozzle is compensated for by changing the amount of ink ejected by the nozzles adjacent to the defective nozzle, it is necessary to change the ejection algorithm (ejection control) accordingly, and hence the burden on the ejection control system becomes very large.

SUMMARY OF THE INVENTION

The present invention has been contrived in view of such circumstances, and an object thereof is to provide a liquid ejection device and an image forming apparatus able to immediately detect and compensate ejection abnormalities on-line, namely, during a print operation or between images.

In order to attain the aforementioned object, the present invention is directed to a liquid ejection device, comprising: an ejection head including a plurality of nozzles which eject droplets of liquid onto an ejection receiving medium; a liquid flow speed determining device which determines a flow speed of the liquid in each of the nozzles, the liquid flow speed determining device being arranged in each of the nozzles; an ejection abnormality detecting device which detects an ejection abnormality in each of the nozzles according to the flow speed of the liquid determined by the liquid flow speed determining device; an ejection direction deflecting device which deflects a direction of ejection of a droplet of the liquid ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the liquid ejected from one of the nozzles adjacent to the abnormal nozzle, by means of the ejection direction deflecting device.

According to the present invention, since the liquid flow speed determining device which determines the flow speed of the liquid inside the nozzle is provided at each nozzle of the ejection head, and since the ejection abnormality detecting device which detects an ejection abnormality from the flow speed of the liquid in the nozzle is provided, it is possible to detect ejection abnormalities in each nozzle on line. Therefore, compensatory ejection can be performed onto the deposition position of the liquid droplet that would have been ejected originally by the nozzle having the ejection abnormality, by using the ejection direction deflecting device provided at each nozzle to deflect the ejection direction of the nozzle adjacent to the nozzle having the abnormality. Consequently, ejection abnormalities can be detected while ejecting liquid droplets, and compensatory ejection can be performed immediately upon detecting an ejection abnormality. Therefore, the ejection receiving medium and ink are not used wastefully.

Furthermore, since each nozzle is provided with the liquid flow speed determining device for determining the flow speed of the liquid in the nozzle, and the ejection direction deflecting device, it is possible to install the liquid flow speed determining device and the ejection direction deflecting device in a compact fashion.

Moreover, "ejection receiving medium" represents a medium onto which liquid droplets are ejected from an ejection head, and more specifically, this term includes various types of media, irrespective of material and size, such as continuous paper, cut paper, sealed paper or other types of paper, resin sheets, such as OHP sheets, film, cloth, and other materials.

Furthermore, the liquid represents various types of liquids which may be ejected from an ejection head, such as water, a chemical, processing liquid, ink, or the like.

The determination of the flow speed of the liquid also includes a configuration where the flow speed (flow rate) of the liquid is determined indirectly by measuring the phenomena and physical properties occurring as a result of the liquid flow.

Here, the term "nozzle" may also represent an ejection hole (opening) which ejects liquid droplets, and it may also represent a narrow passage section in a front tip section which includes an ejection hole. Furthermore, it may also refer generally to the whole structure from a liquid chamber (for instance, a pressure chamber for applying an ejection pressure to the liquid that is to be ejected) up to the ejection hole, including the passage (nozzle passage) connecting to the chamber to the front tip section. More specifically, the term "nozzle" refers generally to the front tip section in which an ejection hole is formed, and to the passage section which connects to this front tip section.

The ejection direction deflecting device may include an electrical field generating device in which a plurality of electrodes are arranged to face the nozzle tip section and the direction of travel of the liquid is bent by causing the electrical field generated by the electrodes to act on the charge in the electrostatically charged liquid; or a temperature altering device which deflects the direction of travel of the liquid by changing the liquid flow speed by producing a distribution to the temperature of the liquid in the nozzle. Desirably, the ejection direction deflecting device is provided at the nozzle opening section which is in the tip section of the nozzle.

Moreover, in order to attain the aforementioned object, the present invention is also directed to a liquid ejection device, comprising: an ejection head including a plurality of nozzles which eject droplets of electrostatically charged liquid onto an ejection receiving medium; a liquid flow speed change determining device which determines a change in a flow speed of the charged liquid inside each of the nozzles from an electrical signal generated according to the change in the flow speed of the charged liquid inside each of the nozzles, the liquid flow speed change determining device being arranged in each of the nozzles; an ejection abnormality detecting device which detects an ejection abnormality in each of the nozzles according to the electrical signal obtained from the liquid flow speed change determining device; an ejection direction deflecting device which deflects a direction of ejection of a droplet of the liquid ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the charged liquid ejected from one of the nozzles adjacent to the abnormal nozzle, by means of the ejection direction deflecting device.

If the liquid flow speed change determining device is provided in the nozzle passage section and the ejection direction deflecting device is provided in the front tip section of the nozzle, then these devices can be provided in a compact fashion.

The liquid flow speed change determining device may include a voltage sensor, such as a coil, which generates a voltage in response to the change in the speed of the charge in charged ink.

The liquid ejection device may further comprise a charging device which electrostatically charges the liquid supplied to the nozzles.

If there is a supply system for supplying liquid to the nozzles from branch flow sections which lead from an accumulating section storing liquid to the respective nozzles via a main flow section, then it is possible to provide the charging device in the main flow section or in the branch flow sections. If the charging device is provided in the main flow section, then it is possible to reduce the number of charging devices required.

The ejection abnormality detecting device may detect an ejection abnormality in each of the nozzles during an operation of retracting a meniscus of the liquid inside each of the nozzles.

If an actuator, such as a piezoelectric element, is used as an ejection pressure application device which applies an ejection pressure to the liquid, then the actuator is controlled in such a manner that an ejection operation is performed after an operation of retracting the meniscus. It is possible to detect an ejection abnormality in a nozzle on the basis of the voltage outputted by the voltage generating device during this meniscus retraction operation.

More specifically, if it is possible to detect an ejection abnormality during retraction of the meniscus, then an ejection abnormality can be detected in the nozzle even without performing liquid ejection. Of course, it is also possible to perform a meniscus retraction operation for the purpose of detecting ejection abnormalities.

Moreover, in order to attain the aforementioned object, the present invention is also directed to a liquid ejection device, comprising: an ejection head including a plurality of nozzles which eject droplets of liquid onto an ejection receiving medium; a temperature altering device which produces a temperature gradient in a circumferential direction of each of the nozzles to the liquid inside each of the nozzles by selectively applying heat to the liquid, the temperature altering device being arranged in each of the nozzles around a perimeter of each of the nozzles and being divided in the circumferential direction of each of the nozzles; a temperature determining device which determines temperature of the liquid inside each of the nozzles, the temperature determining device being arranged in each of the nozzles on at least one of an upstream side and a downstream side of the temperature altering device in a direction of flow of the liquid; an ejection abnormality detecting device which detects an ejection abnormality in each of the nozzles according to the temperature of the liquid determined by the temperature determining device; an ejection compensation control device which performs control in such a manner that, when an abnormal one of the nozzles having an ejection abnormality is detected by the ejection abnormality detecting device, a compensatory ejection is performed by deflecting a direction of ejection of a droplet of the liquid ejected from one of the nozzles adjacent to the abnormal nozzle, by means of the temperature altering device.

According to the present invention, if the temperature of the liquid inside the nozzle is raised by the temperature altering device, then a temperature distribution in the circumferential direction of the nozzle is produced in the liquid inside the nozzle, and the flow speed of the liquid inside the nozzle can be determined from this temperature distribution. An ejection abnormality can be detected from the liquid flow speed thus determined. Furthermore, by producing a temperature gradient to the liquid inside the nozzle, it is also possible to create a distribution in the flow speed of the liquid in the nozzle, and hence cause the ejection direction of the liquid to be deflected.

The temperature altering device may be provided on the upstream side or the downstream side of the temperature determining device, in respect of the direction of flow of the liquid. Of course, temperature altering devices may also be provided on both the upstream side and the downstream side.

Here, the temperature determining device may determine the liquid temperature directly, or alternatively, a non-contact-type determining device may be used.

Preferably, the liquid ejection device further comprises: a movement device which moves at least one of the ejection receiving medium and the ejection head to move the ejection receiving medium and the ejection head relatively to each other in a relative movement direction, wherein the ejection compensation control device implements control in such a manner that, if the abnormal nozzle is detected by the ejection abnormality detecting device when ejecting droplets in a first main scanning line, a compensatory ejection is performed by using the one of the nozzles adjacent to the abnormal nozzle, when ejecting droplets in a second or subsequent main scanning line that are ejected after the first main scanning line.

According to the present invention, if a nozzle having an ejection abnormality is detected, then during ejection of the next line on the downstream side in the direction of relative movement of the ejection receiving medium, a compensatory ejection is performed by the nozzle that ejects liquid forming a dot adjacent to the dot that would have been formed by the liquid ejected from the abnormal nozzle. The compensatory ejection is performed onto the deposition position of the liquid droplet that would have been ejected by the abnormal nozzle. Therefore, an ejection abnormality can be detected during ejection and suitable compensation can be performed immediately, during ejection of the subsequent line.

The relative movement of the ejection receiving medium and the ejection head may be achieved by moving the ejection receiving medium with respect to a stationary (fixed) ejection head, or by moving the ejection head with respect to a stationary ejection receiving medium. Alternatively, it is also possible to move both the ejection receiving medium and the ejection head.

With respect to the upstream side and the downstream side in the relative direction of conveyance, in the case of the ejection receiving medium, the side onto which liquid is ejected first is taken to be the upstream side, and in the case of the ejection head, the side which ejects liquid first is taken to be the upstream side.

Preferably, the ejection head includes a full line ejection head having nozzle rows arranged two-dimensionally and of a length corresponding to a full dimension of a receivable width on the ejection receiving medium; and the ejection compensation control device implements control in such a manner that, if the abnormal nozzle is detected by the ejection abnormality detecting device, a compensatory ejection is performed by deflecting the direction of ejection of the droplet of the liquid ejected from the one of the nozzles adjacent to the abnormal nozzle disposed on a downstream side of the abnormal nozzle in the relative movement direction of the ejection receiving medium, the direction of ejection being deflected in a direction substantially perpendicular to the relative movement direction of the ejection receiving medium.

According to the present invention, since ejection abnormalities are detected during liquid ejection, it is possible to perform compensatory ejection immediately by using an adjacent nozzle located on the downstream side in the relative conveyance direction of the ejection receiving medium with respect to the ejection head (namely, the nozzle following the nozzle having the ejection abnormality).

The two-dimensional nozzle arrangement may involve nozzles arranged in a direction substantially perpendicular to the relative conveyance direction of the ejection receiving medium, or it may involve nozzles arranged at a prescribed angle to a direction substantially perpendicular to the relative conveyance direction. In the case of nozzle rows arranged two-dimensionally as described above, adjacent nozzles not only means the nozzles which are mechanically adjoining, but also includes nozzles which eject liquid to form adjacently positioned dots, even if these nozzles are not mechanically adjoining.

Of the two ends of the ejection receiving medium in the relative conveyance direction, if the end on the side where the liquid is first ejected from the ejection head is taken to be the front end and the other end is taken to be the rear end, then by combining a plurality of short head units having nozzle rows which do not reach a length corresponding to the full width of the ejection receiving medium in the full line ejection head, it is possible to compose a nozzle row corresponding to the full width of the ejection receiving medium by means of the overall configuration of these units.

Moreover, the ejection compensation control device may implement control in such a manner that a volume of liquid ejected in the compensatory ejection is substantially equal to a volume of liquid that would originally have been ejected from the abnormal nozzle. According to this, since a volume of liquid substantially equal to the volume of liquid that would originally have been ejected from the nozzle having the ejection abnormality is ejected in compensatory ejection, it is not necessary to change the liquid ejection method (ejection algorithm).

Moreover, in order to attain the aforementioned object, the present invention is also directed to an image forming apparatus, comprising: a recording head having a plurality of nozzles which eject droplets of ink onto an ejection receiving medium; an ink flow speed determining device which determines a flow speed of the ink in each of the nozzles, the ink flow speed determining device being arranged in each of the nozzles; an ejection abnormality detecting device which detects an ejection abnormality in each of the nozzles according to the flow speed of the ink determined by the ink flow speed determining device; an ejection direction deflecting device which deflects a direction of ejection of a droplet of the ink ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the ink ejected from one of the nozzles adjacent to the abnormal nozzle, by means of the ejection direction deflecting device.

According to the present invention, since an ejection abnormality is detected during image formation and compensatory ejection is performed immediately, there is no wastage of the ejection receiving medium or the ink.

The ejection receiving medium may also be called an image forming medium, print medium, image receiving medium, recording medium, or the like.

According to the present invention, a liquid flow speed determining device which determines the flow speed of a liquid in a nozzle and an ejection direction deflecting device for deflecting the ejection direction of the liquid ejected by the nozzle are provided in each nozzle of an ejection head. An ejection abnormality is detected from the flow speed of the liquid in the nozzle and control is implemented in such a manner that compensatory ejection is performed by deflecting the ejection direction of liquid ejected from a nozzle adjacent to a nozzle having an ejection abnormality. Therefore, ejection abnormalities can be detected and compensatory ejection for ejection abnormalities can be performed on line.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
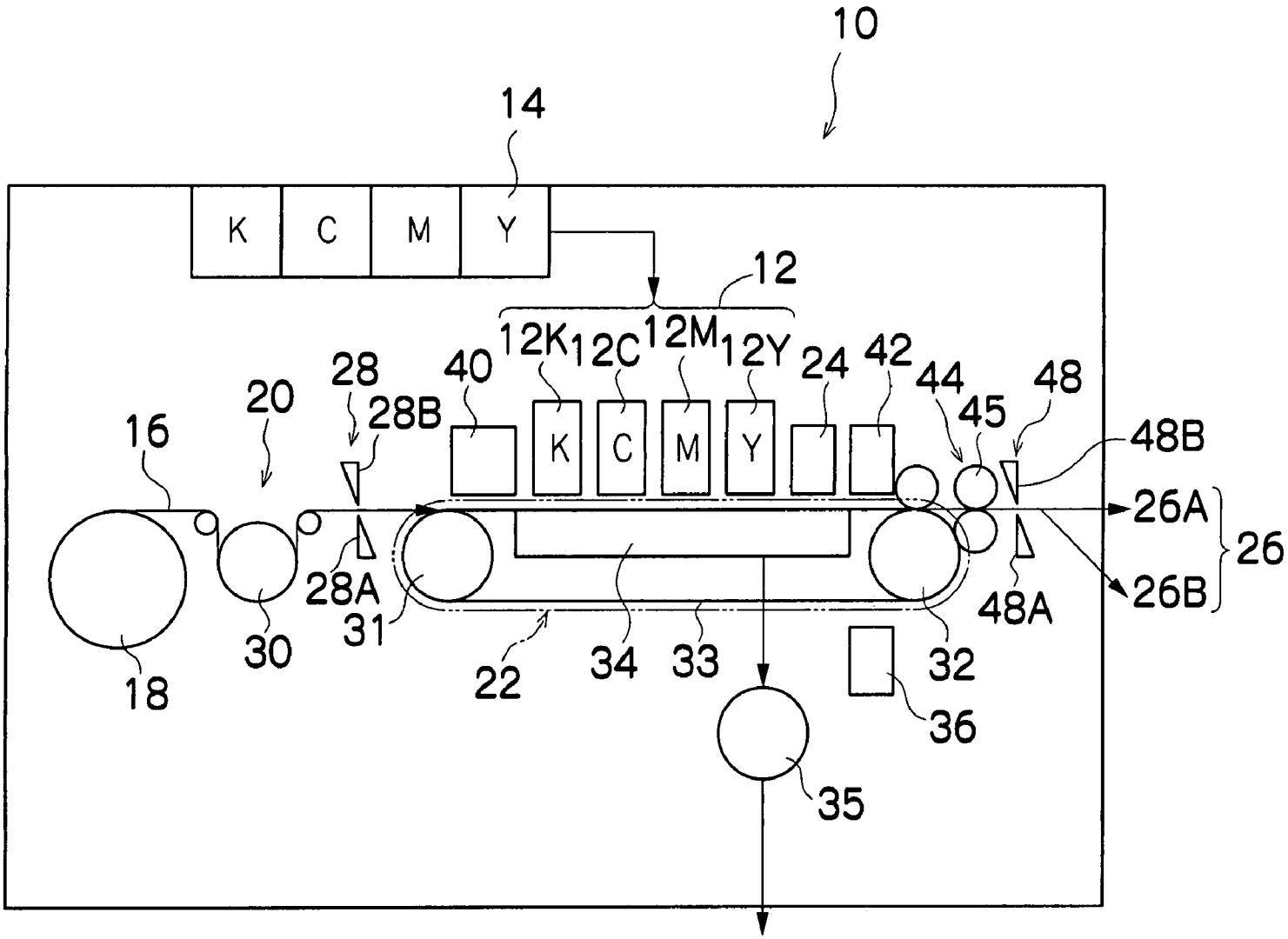
FIG. 1 is a basic compositional diagram of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
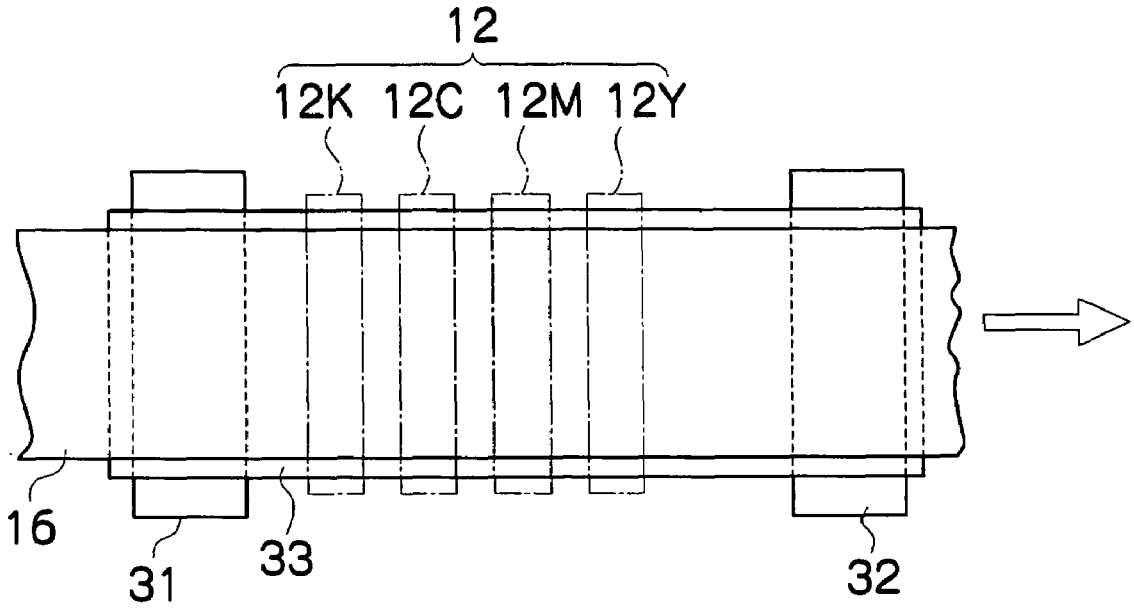
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
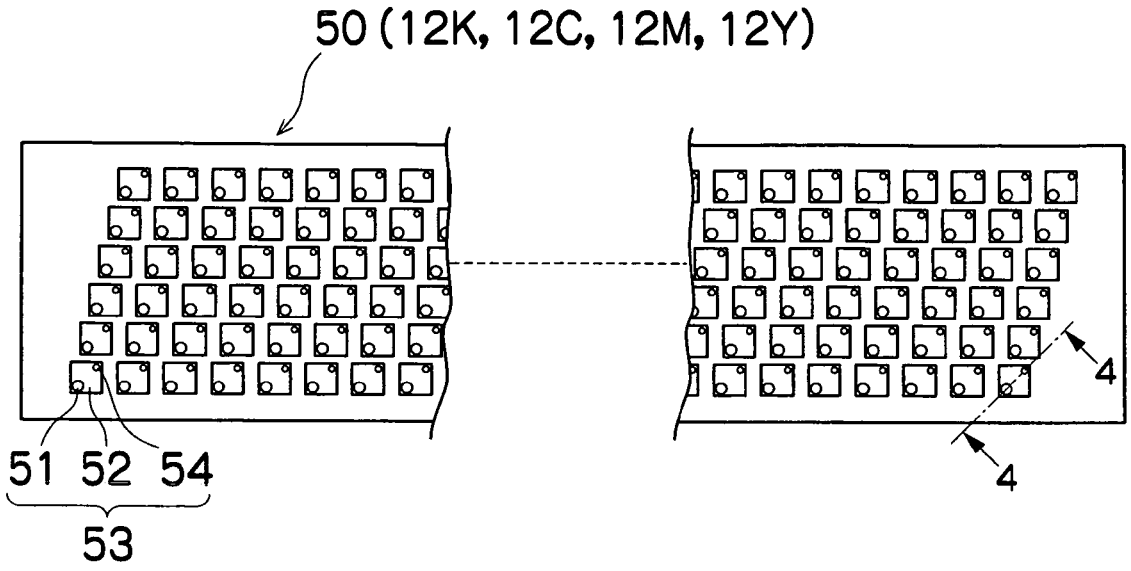
FIG. 3A is a perspective plan view showing an example of a configuration of a print head.
Figure 3B:
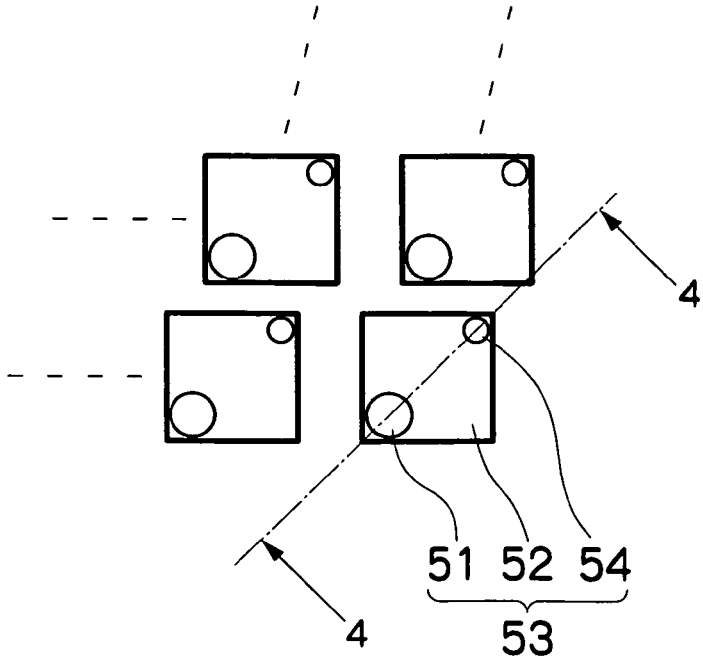
FIG. 3B is a partial enlarged view of FIG. 3A.
Figure 3C:
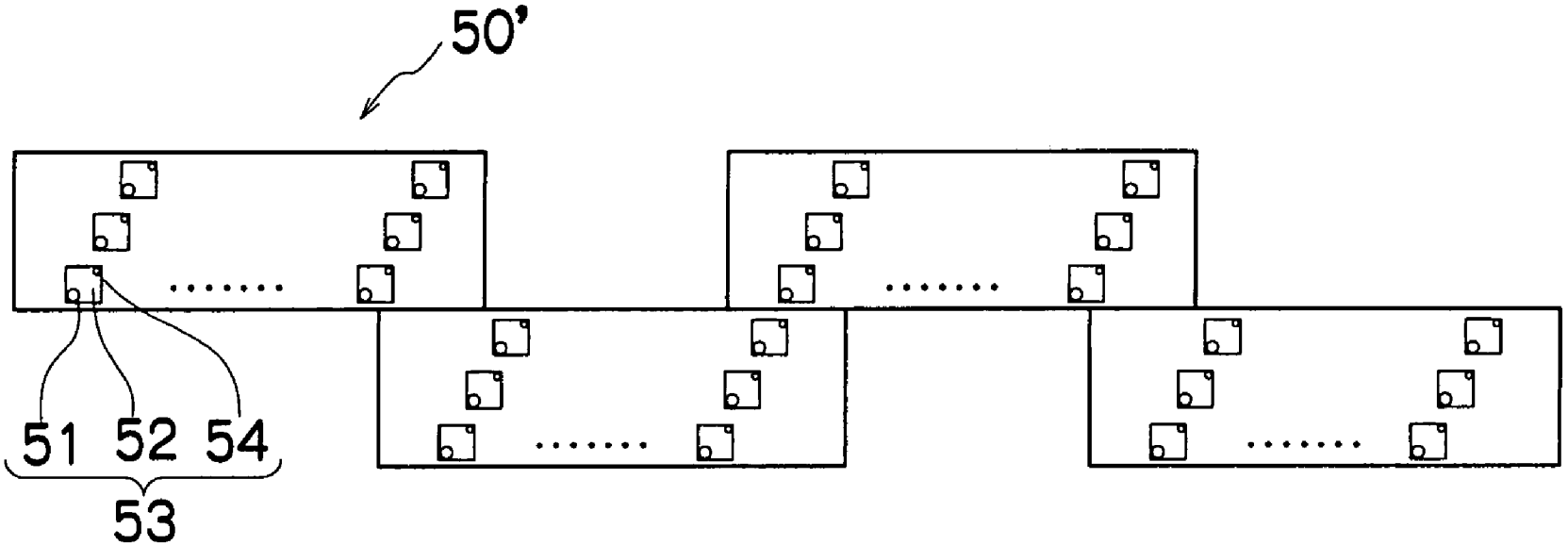
FIG. 3C is a perspective plan view showing another example of the configuration of the print head.
Figure 4:
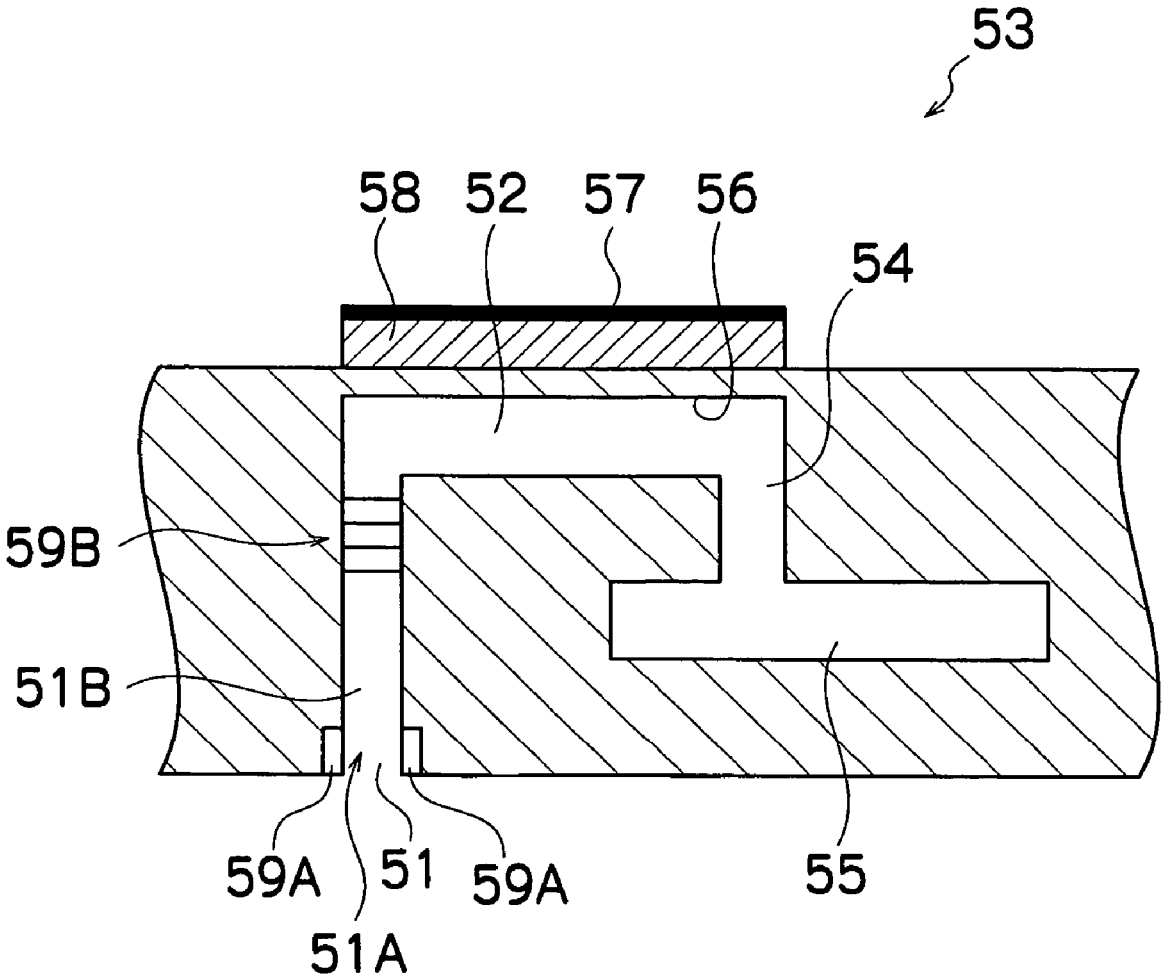
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink ejecting nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and a supply port 54 are disposed in both corners on a diagonal line of the square. Each pressure chamber 52 is connected to a common channel 55 through the supply port 54.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

A flight direction deflecting device for controlling the direction of flight of the ink droplet ejected from the nozzle is installed in each nozzle provided in the print head 50. Furthermore, an ejection abnormality detecting device is provided in each nozzle in order to detect ejection abnormalities including ejection failure at the nozzle online, in such a manner that ejection defects occurring during droplet ejection can be detected at each individual nozzle.

For example, electrodes 59A are arranged at the opening section 51A of each nozzle as a flight direction deflecting device for deflecting the direction of flight of an ink droplet ejected through the nozzle. By using electrostatically-charged ink as the ink ejected from the nozzles 51 and by applying an electric field generated by the electrodes 59A to the charged ink droplet ejected, it is possible to change the direction of flight of the ink droplet.

On the other hand, a coil 59B is arranged in the nozzle passage 51B forming the ink flow path from the pressure chamber 52 to the nozzle opening section 51A. When the charged ink passes through the region where the coil 59B is arranged, a voltage is induced in the coil 59B according to the change in the flow speed of the ink. The coil 59B thereby functions as an ejection determination device that allows the ink ejection status to be judged on the basis of the voltage induced in the coil 59B. If the voltage induced in the coil 59B is very small, then an amplifying device for amplifying the voltage may be provided.

The structure of the ink chamber unit 53 shown in FIG. 4 is the basic structure of an ink chamber unit comprising a piezo (PZT) type actuator. It is also possible to use ink chamber units having various other structures apart from this.

Figure 5:
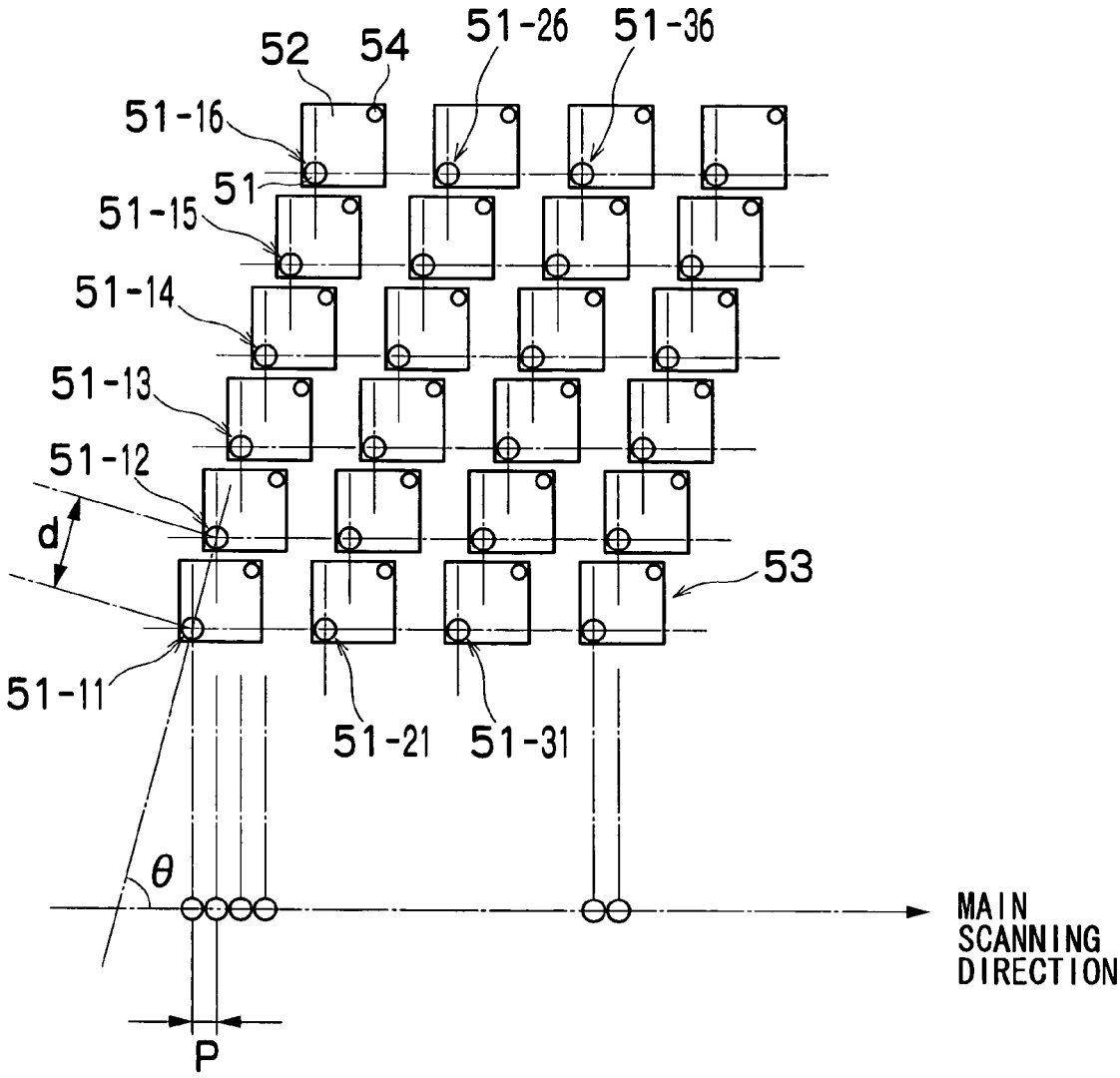
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for ejecting ink is not limited in particular, and instead of the piezo jet method, it is also possible to apply various types of methods, such as a thermal jet method where the ink is heated and bubbles are caused to form therein by means of a heater, ink droplets being ejected by means of the pressure of these bubbles.

Figure 6:
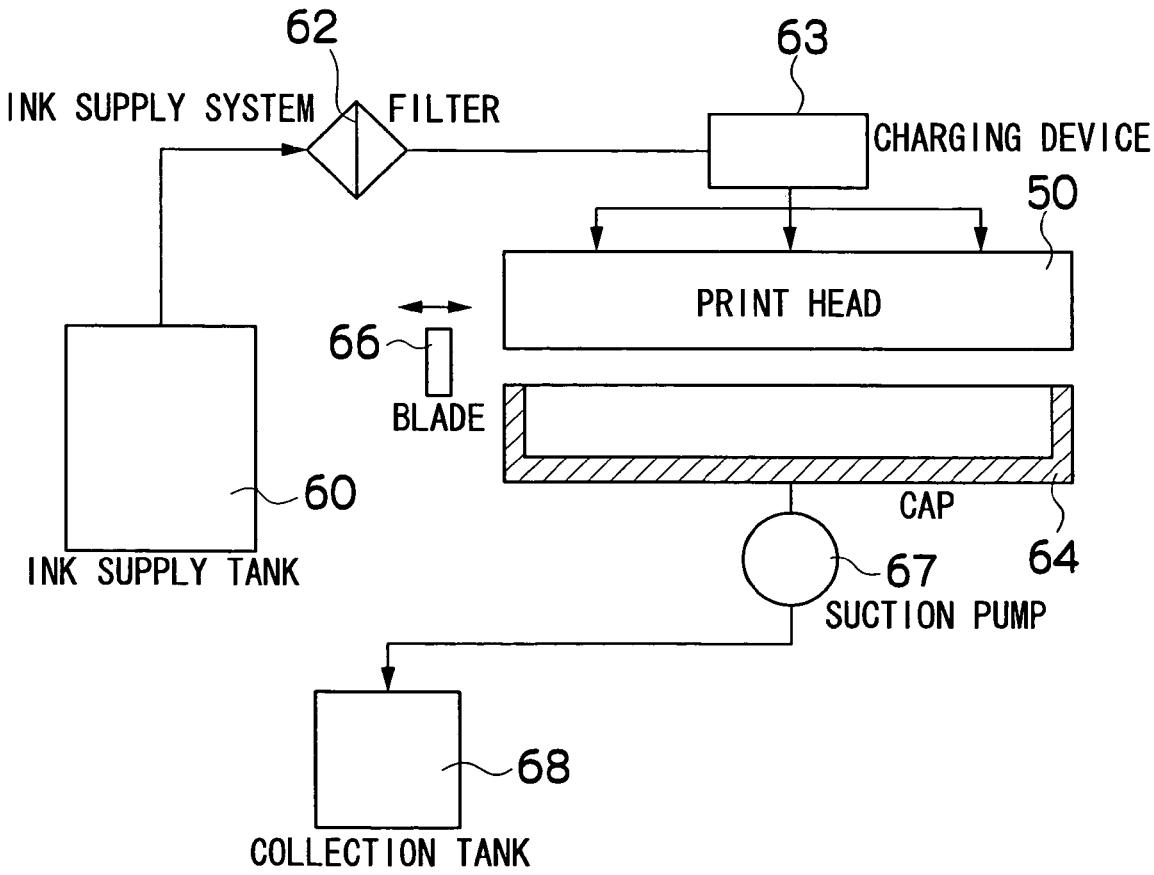
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

A charging device 63 for electrostatically charging the ink supplied to the print head 50 is arranged on the upstream side of the print head 50. The charging device 63 may be arranged on the upstream side of the nozzle 51, or it may be arranged inside the print head 50. Furthermore, if previously charged ink is used, then it is also possible to omit the charging device 63.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

During printing or standby, when the frequency of use of a specific one of the nozzles 51 is reduced and a state in which ink is not ejected from the specific nozzle continues for a certain amount of time or longer, the ink solvent in the vicinity of the nozzle evaporates and the ink viscosity increases. In such a state, the ink can no longer be ejected from the nozzle 51 even if the actuator 58 is operated.

Before reaching such a state, the actuator 58 is operated (in a viscosity range that allows ejection of the ink by the operation of the actuator 58), so that the preliminary ejection ("purge", "empty ejection", "liquid ejection", "dummy ejection") is made to discharge the degraged ink (whose viscosity has increased in the vicinity of the nozzle) toward the cap 64 (the ink receptor).

Also, when bubbles have become intermixed in the ink inside the print head 50 (inside the pressure chamber 52), ink can no longer be ejected from the nozzles even if the actuator 58 is operated. In such a case, the cap 64 is placed on the print head 50, the ink (in which bubbles have become intermixed) inside the pressure chamber 52 is removed by suction with a suction pump 67, and the suction-removed ink is sent to a collection tank 68.

This suction action entails the suctioning of degraded ink whose viscosity has increased (hardened) when initially loaded into the head, or when service has started after a long period of being stopped. However, this suction action is performed with respect to all the ink in the pressure chamber 52, so that the amount of ink consumption is considerable. Therefore, a preferred aspect is one in which a preliminary ejection is performed when the increase in the viscosity of the ink is small.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped and cleaned by sliding the cleaning blade 66 on the nozzle plate. In the case of cleaning the ink ejection surface of the print head 50 by means of the blade, a preliminary ejection is performed so as to prevent foreign matter getting into the nozzles 51.

Figure 7:
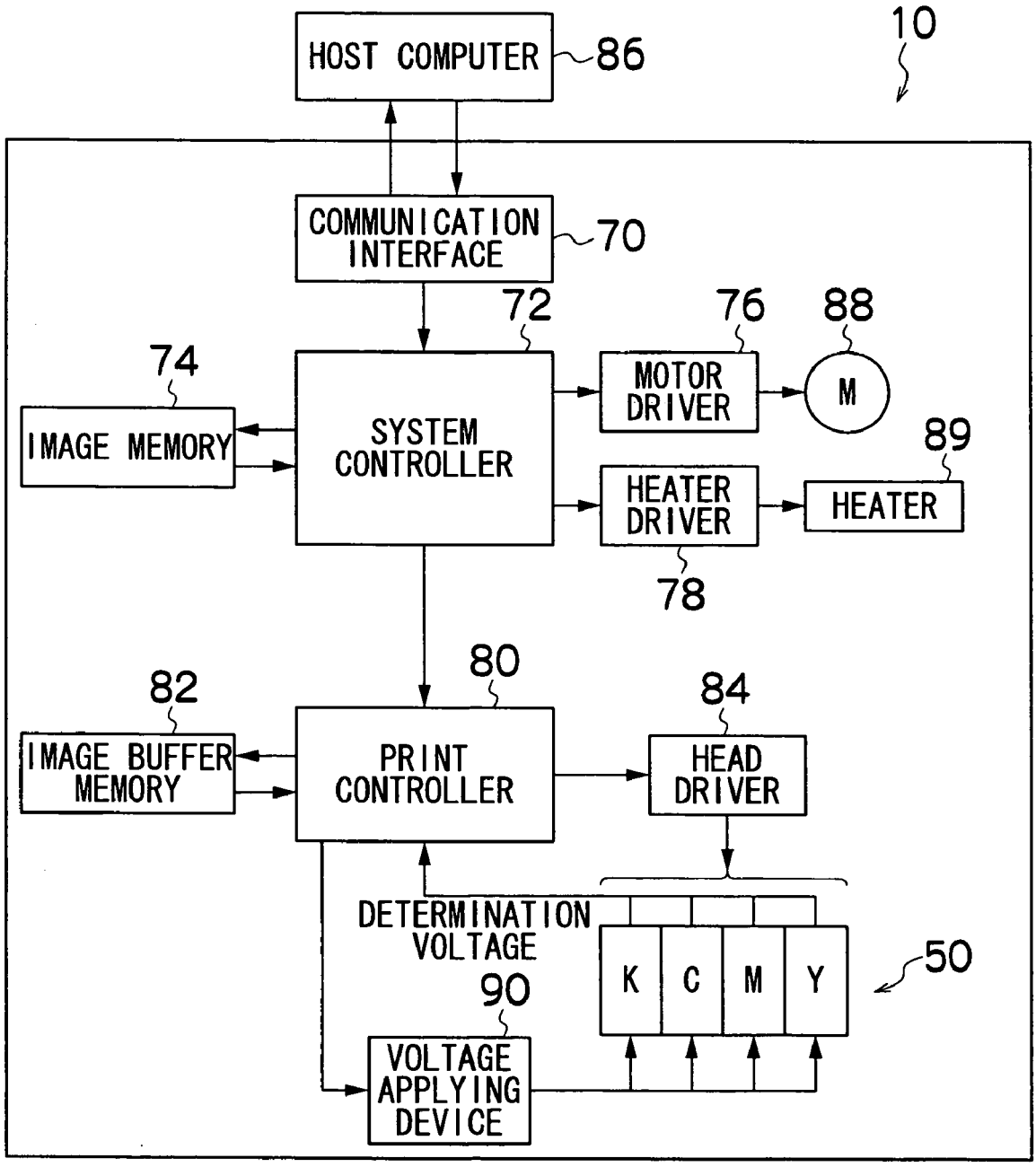
FIG. 7 is a principal block diagram showing the system composition of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (image formation data) to the head driver 84. Prescribed signal processing is carried out in the print control unit 80, and the ejection amount and the ejection timing of the ink droplets from the respective print heads 50 are controlled via the head drier 84, on the basis of the image data. By this means, prescribed dot sizes and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators for the print heads 50 (12K, 12C, 12M and 12Y) of the respective colors on the basis of the print data received from the print controller 80. A feedback control system for keeping the drive conditions for the print heads 50 constant may be included in the head driver 84.

Furthermore, the print controller 80 acquires a determination voltage induced in the coil 59B provided at each nozzle shown in FIG. 4 and is thereby able to judge the ink ejection status at the nozzles. More specifically, the ink flow speed and the amount of change in the ink flow speed inside each nozzle passage are determined from the determination voltages, and if the ink flow speed or the amount of change in the ink flow speed is less than a prescribed value, then the nozzle in question is judged to have an ejection abnormality.

If a nozzle with an ejection abnormality is detected, then the print controller 80 performs complementary ink ejection for the abnormal nozzle, by using normal nozzles that are situated adjacently to the abnormal nozzle.

For example, by applying a voltage through a voltage applying device 90 to the electrodes 59A provided at a nozzle adjacent to a nozzle with an ejection abnormality, thereby deflecting the direction of flight of the ink droplet ejected from the adjacent nozzle, it is possible to deposit the ink droplet at the same ink deposition point at which the abnormal nozzle would originally have deposited ink.

The voltage applying device 90 comprises a power source for applying voltage to the electrodes 59A shown in FIG. 4, and a switching device (bipolar transistor, field effect transistor, or the like) for switching the voltage supplied from the power source on and off, on the basis of a control signal received from the print controller 80.

Various control programs are stored in a program storage section (not shown), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided. The program storage section may also be combined with a storage device for storing operational parameters, and the like (not shown).

Detection and Compensation of Ejection Abnormality

Next, the functions of detecting and compensating ejection abnormalities in the inkjet recording apparatus 10 according to an embodiment of the present invention is described.

As shown in FIG. 4, the electrodes 59A and the coil 59B are arranged at each nozzle provided in the print head 50 of the inkjet recording apparatus 10. Electrostatically-charged ink is supplied to the ink chamber unit 53, and when the charged ink flows along the nozzle passage 51B where the coil 59B is arranged, a voltage corresponding to the change in the flow speed of the charged ink is induced in the coil 59B. By measuring the voltage induced in the coil 59B, it is possible to determine the flow speed of the ink in the nozzle passage 51B. The ejection status of the ink ejected from the nozzle 51 can be judged from the flow speed of the ink in the nozzle passage 51B thus determined. More specifically, it is possible to judge whether or not ejection is possible from any particular nozzle, by considering that an ejection failure has occurred if the change in the flow speed of the ink inside the nozzle passage 51B has deviated from a prescribed pattern of change.

In other words, a flow speed determining device is provided in order to determine the flow speed of the ink in the nozzle passage 51B, and the flow speed determining device is able to function as an ejection determination device for judging an ejection abnormality in the nozzle 51 from the results of flow speed determination.

In the ejection abnormality detection process described above, it is also possible to detect an ejection abnormality in the nozzle during the meniscus retraction operation, since a voltage corresponding to the flow speed of the ink is also induced in the coil 59B during this operation.

When a nozzle having an ejection abnormality is identified, a compensatory nozzle for performing a compensatory ejection for the abnormal nozzle is selected, and a compensatory ejection control signal (compensatory print data) is transmitted to that compensatory nozzle. The compensatory nozzle thus selected is a nozzle that is adjacent to the nozzle with the ejection abnormality and that is originally not engaged in ejecting an ink droplet.

In compensatory ejection, a dot is formed by ink ejected from the compensatory nozzle, by deflecting the direction of flight of the ink droplet ejected from the compensatory nozzle so as to land at the position where a dot would have been formed originally by an ink droplet ejected by the nozzle with the ejection abnormality.

The volume of the ink droplet ejected from the compensatory nozzle is substantially the same as the volume of the ink droplet that would have been ejected from the abnormal nozzle, and hence the size of the dot formed by the ink droplet ejected from the compensatory nozzle is substantially the same as the size of the dot that would have been formed originally.

More specifically, an electrical field is generated by the electrodes 59A arranged in the vicinity of the opening section 51A of each nozzle (the nozzle tip section), and when charged ink passes through the electrical field, the flow of charged ink is bent in the direction in which the electrical field is acting. In this way, the direction of flight of the ink ejected from the nozzle 51 can be controlled.

In other words, the direction of flight of the ink droplet is controlled by adjusting the direction and the intensity of the electrical field generated by the electrodes 59A.

For example, when performing compensation for an adjacent position, then if the ink has a charge of 10 $C/m^3$ and the viscosity of 2 cP (standard ink viscosity), then the voltage applied to the electrodes 59A is approximately 20V. The figures given above are examples, and they may vary depending on the intervals between dots and between nozzles.

Figure 8:
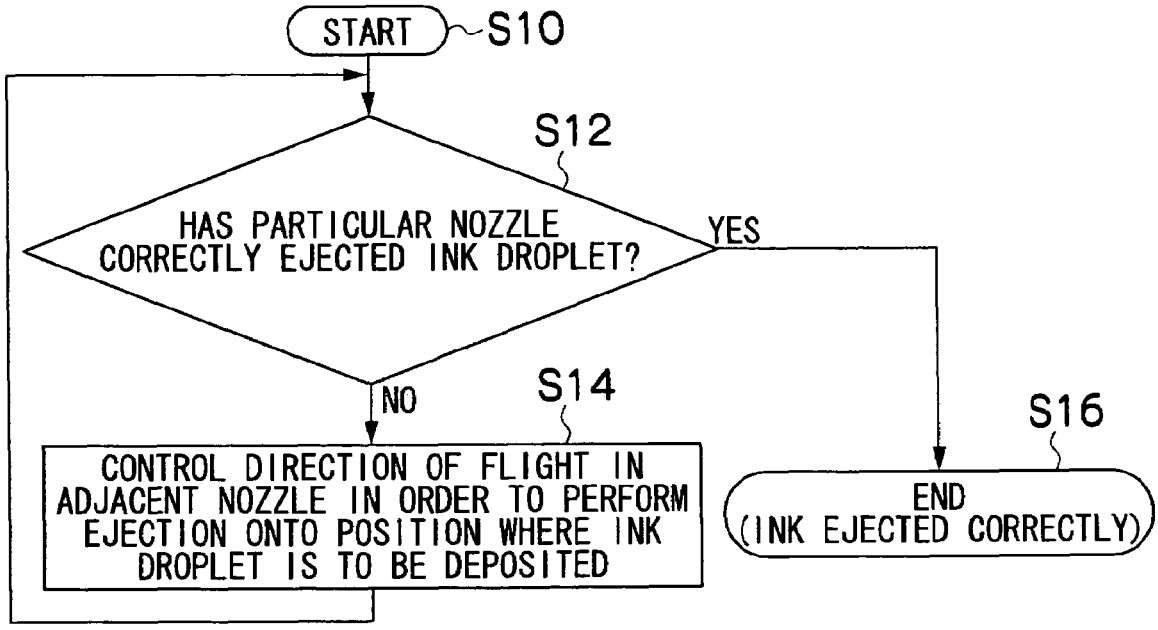
FIG. 8 is a flowchart showing a control sequence for ejection abnormality detection and ejection abnormality compensation in the inkjet recording apparatus.

FIG. 8 is a flowchart showing a control sequence for the ejection abnormality detection and ejection abnormality compensation described above.

When print control is implemented and ink droplets are ejected from the nozzles 51, a process for performing ejection abnormality detection and ejection compensation control is initiated (step S10). It is judged whether or not an ink droplet has been ejected correctly from a particular nozzle, on the basis of the determination voltage obtained from the coil 59B (step S12).

At step S12, if it is judged that the ink droplet has not been ejected correctly from the nozzle (in order words, that an ejection abnormality has occurred) (NO verdict), then a compensatory nozzle is selected from among the nozzles adjacent to the abnormal nozzle, and a compensatory ejection is performed by controlling the direction of flight of an ink droplet ejected from that compensatory nozzle (step S14). When the compensatory ejection has been performed, the sequence returns to step S12, and the ejection status of the compensatory nozzle is judged.

At step S12, if the selected compensatory nozzle is judged to have an ejection abnormality, then yet another nozzle is selected as a compensatory nozzle, and compensatory ejection is performed again. This control sequence is repeated until a desirable compensatory ejection has been performed.

On the other hand, at step S12, if it is judged that the ink has been ejected normally (YES verdict), then the control sequence for ejection abnormality detection and ejection abnormality compensation terminates (step S16).

Next, a control sequence for ejection abnormality detection and ejection abnormality compensation in the print head 50 having the nozzles 51 (the ink chamber units 53) arranged in the staggered matrix as shown in FIGS. 3A to 3C and 5 is described in detail.

In the case of nozzles arranged in a two-dimensional staggered matrix as shown in FIG. 5, the nozzles forming adjacent dots in the direction substantially perpendicular to the recording paper conveyance direction are not aligned in the direction substantially perpendicular to the recording paper conveyance direction. More specifically, the nozzle which forms a dot that is adjacent, in the direction substantially perpendicular to the recording paper conveyance direction, to a dot formed by the nozzle 51-11 is the nozzle 51-12, and these nozzles 51-11 and 51-12 are not aligned in the direction substantially perpendicular to the recording paper conveyance direction.

Therefore, if an ejection abnormality has been detected in the nozzle 51-11, then when the nozzle 51-12 arrives at a position on a line substantially perpendicular to the recording paper conveyance direction from the position at which a dot would be formed by an ink droplet ejected by the original nozzle 51-11, the ejection abnormality in the nozzle 51-11 can be compensated using the nozzle 51-12, by deflecting the direction of flight of an ink droplet ejected from the nozzle 51-12 in the direction substantially perpendicular to the recording paper conveyance direction.

Figure 9:
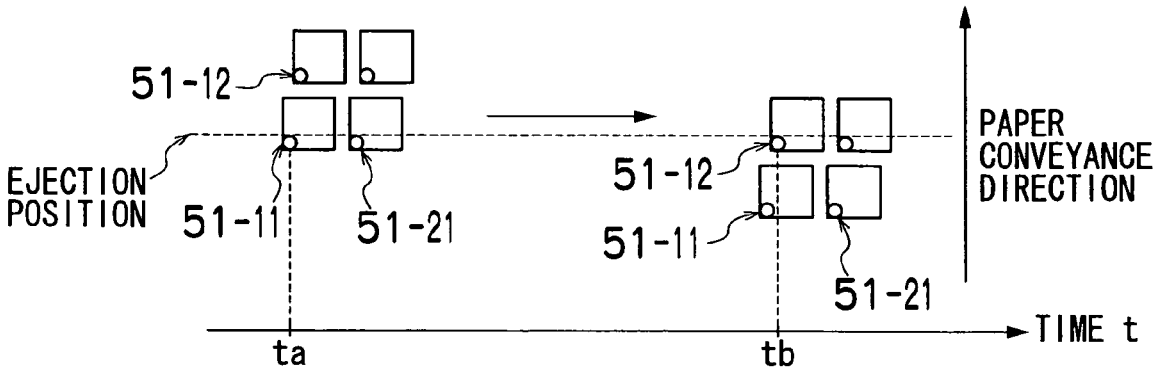
FIG. 9 is a diagram illustrating compensatory ejection in a matrix head.

More specifically, as shown in FIG. 9, if a dot that would be formed by an ink droplet ejected from the original nozzle 51-11 at timing ta has not been formed due to an ejection abnormality in the nozzle 51-11, then this dot is formed by means of an ink droplet ejected from nozzle 51-12 at timing tb, whose direction of flight is deflected in the direction substantially perpendicular to the recording paper conveyance direction.

According to this method, apart from the final nozzle row including the nozzles 51-16, 51-26, . . . , 51-N, it is possible to perform compensatory ejection for a nozzle having an ejection abnormality, by deflecting the direction of flight of an ink droplet ejected from a compensatory nozzle, in the direction substantially perpendicular to the recording paper conveyance direction. In FIG. 9, the positions on the broken line represent the ejection positions (the ink deposition positions) on the recording paper 16.

Figure 10:
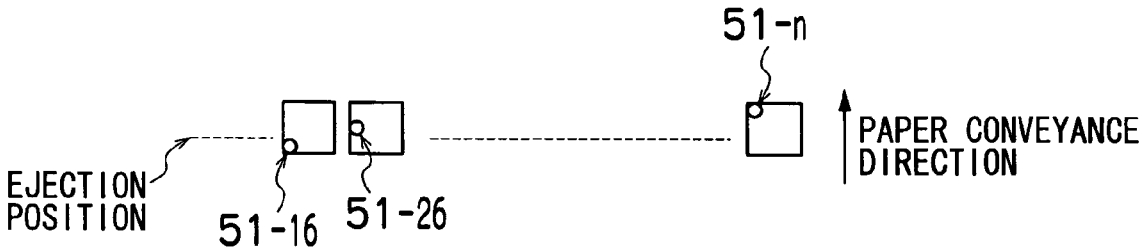
FIG. 10 is a diagram showing a nozzle arrangement in a final nozzle row in a matrix head.

Here, if a nozzle arrangement such as that shown in FIG. 10 is used, then compensatory ejection for the final nozzle row becomes possible.

In the case of the nozzle arrangement shown in FIG. 5, the nozzles of the ink chamber units arranged in the direction substantially perpendicular to the recording paper conveyance direction are aligned in parallel with the direction substantially perpendicular to the recording paper conveyance direction.

On the other hand, in the nozzle arrangement illustrated in FIG. 10, the nozzles of the ink chamber units arranged in parallel with the direction substantially perpendicular to the recording paper conveyance direction are located at positions that are displaced from each other within the ink chamber units in the recording paper conveyance direction. By adopting an arrangement of this kind for the final nozzle row containing the nozzles 51-16, 51-26, . . . , 51-N, compensatory ejection can also be performed in respect of ejection abnormalities in this final nozzle row containing the nozzles 51-16, 51-26, . . . , 51-N, by deflecting the direction of flight of ink droplets from nozzles within the same nozzle row, in the direction substantially perpendicular to the recording paper conveyance direction.

Figure 11:
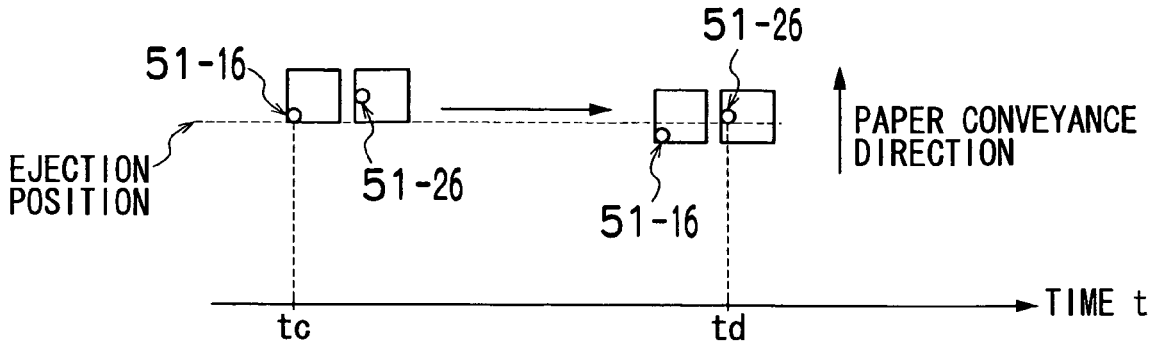
FIG. 11 is a diagram illustrating compensatory ejection in a final nozzle row of a matrix head.

FIG. 11 shows an example of compensatory ejection in the case of the nozzle arrangement shown in FIG. 10. In FIG. 11, if a nozzle has an ejection abnormality, then a compensatory nozzle is selected from among the nozzles that would not eject an ink droplet to form a dot adjacent to a dot that would be formed by an ink droplet ejected from the abnormal nozzle. Recovery for the nozzle having the ejection abnormality can be achieved by deflecting the direction of flight of an ink droplet ejected from the selected compensatory nozzle, by a large amount, in the direction substantially perpendicular to the paper conveyance direction.

More specifically, if a dot that would be formed by an ink droplet ejected by the nozzle 51-16 at timing tc is not formed due to an ejection abnormality in the nozzle 51-16, then it is possible to form the dot that would have been formed by the ink droplet ejected from the original nozzle 51-16, by performing a compensatory ejection from the nozzle 51-26 at timing td.

By adopting compensatory ejection as described with reference to FIGS. 9 to 11, it is possible to perform compensatory ejection for all of the nozzles except for a nozzle 51-N in FIG. 10.

Here, it is not possible to perform a compensatory ejection for the nozzle 51-N by means of control which deflects the direction of flight of an ink droplet ejected from the compensatory nozzle in the direction substantially perpendicular to the recording paper conveyance direction only. However, since the nozzle 51-N is a nozzle that forms a dot at the very edge of the recording paper, it can be considered that the quality of the resulting image will not be affected even if an ejection abnormality does occur in the nozzle 51-N. Therefore, it can be considered that compensatory ejection is not necessary for the nozzle 51-N.

In a print head having a single nozzle row in the direction substantially perpendicular to the recording paper conveyance direction, compensatory ejection for a nozzle having an ejection abnormality is performed when the next line on the downstream side of the paper conveyance direction is printed. In this case, if a nozzle having an ejection abnormality is detected, then compensation for the abnormal nozzle is made by causing an ink droplet ejected from an adjacent nozzle to fly obliquely rearwards.

In the inkjet recording apparatus 10 having the composition described above, an ejection abnormality in any of the nozzles is detected online, on the basis of a determination voltage obtained from the coil 59B that is disposed in each nozzle of the print head 50. A compensatory ejection is performed to compensate a pixel defect caused by the ejection abnormality, by using a compensatory nozzle selected from the nozzles adjacent to the nozzle having the ejection abnormality. Thus, even if an ejection abnormality occurs in a nozzle, this does not lead to missing pixels in the image formed on the recording media, and hence the recording media is not wasted.

By controlling the direction of flight of an ink droplet ejected from the compensatory nozzle during pixel compensation (compensatory ejection) and ejecting substantially the same volume of ink as the ink volume that would originally have been ejected onto the deposition point where the original dot was to have been formed, it is possible to perform compensation for an ejection abnormality simply by substituting part of the dot data, and without having to make significant changes to the droplet ejection algorithm (the ejection control sequence). In order to change the volume of the ink droplet ejected from the compensatory nozzle, significant changes to the droplet ejection algorithm are required. Making significant changes to the droplet ejection algorithm places an increased burden on the control system, and may affect printing speed, and the overall control of the apparatus. Therefore, it is desirable to achieve compensatory ejection without making significant changes to the droplet ejection algorithm.

Moreover, since each nozzle is provided with the detecting device (the coil 59B) for detecting an ejection abnormality, it is possible to identify a nozzle having an ejection abnormality, and hence compensatory ejection can be performed reliably by nozzles that are adjacent to the abnormal nozzle.

In the above-described embodiments, the compensatory dot formed by compensatory ejection is of the same size as the dot that would have been formed originally. However, it is also possible to form a compensatory dot having a larger diameter than the original dot, as illustrated by the practical examples shown in FIGS. 12A and 12B.

Figure 12A:
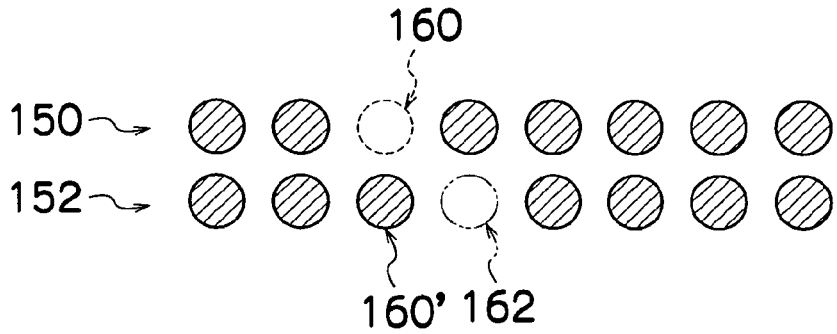
FIGS. 12A and 12B are diagrams showing a practical example of compensatory ejection according to the present embodiment.
Figure 12B:
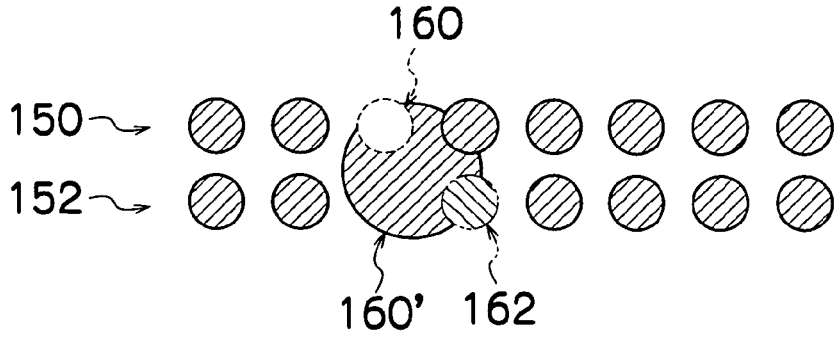

These practical examples are described here with reference to FIGS. 12A and 12B.

FIGS. 12A and 12B show rows of dots formed on recording paper 16 by means of ink droplets ejected from the print head 50.

A dot row 150 is a first main scanning line in which dots are arranged in the sub-scanning direction, and a dot row 152 is a second main scanning line formed by ink droplets deposited after the first main scanning line.

As shown in FIG. 12A, when forming the first main scanning line 150, if an ejection abnormality, such as an ejection failure, occurs in the nozzle (for example, nozzle 51-11 in FIG. 9) that is to eject an ink droplet forming a dot 160 (shown with a broken line in FIG. 12A), then the dot 160 is not formed and the first main scanning line 150 contains a missing dot at the formation position of the dot 160.

If the nozzle having the ejection abnormality is detected, then when forming the second main scanning line 152 in FIG. 12A, a compensatory dot 160' is formed by taking a nozzle adjacent to the abnormal nozzle as a compensatory nozzle and deflecting the direction of flight of an ink droplet ejected from this compensatory nozzle so that it lands at the position where the dot 160 was originally to be formed.

By performing compensatory ejection as described above, it may happen that a dot 162 (shown with an alternate long and two short dashes line in FIGS. 12A and 12B) that was originally to be formed by the ink droplet ejected from the compensatory nozzle is omitted; however, by repeating the main scanning lines in two cycles, one for compensation and one without compensation, it is possible to reduce the occurrence of streaks, gaps, or the like, which may appear in the sub-scanning direction.

Alternatively, as shown in FIG. 12B, it is also possible for the size of the compensatory dot 160' to be larger than the size of the dot 160 that would originally have been formed. If the compensatory dot 160' is set to a large dot size, then it is preferable that the landing position (deposition point) of the ink droplet is set to a position on the straight line linking the center of the dot 160, which was not formed due to the ejection abnormality, and the center of the dot that would originally have been formed by an ink droplet ejected from the compensatory nozzle; and the landing position is the center point between the center of the dot 160 and the center of the dot 162. Of course, when the compensatory dot 160' is set to a large dot size, it is also possible to set the center of the compensatory dot to the center of the dot 160 or the center of the dot 162.

Furthermore, if the compensatory dot 160' is set to a large dot size, then it is preferable that the size of the compensatory dot 160 is determined in accordance with the size of the adjacent dots, the pitch between dots in the main scanning direction, and the pitch between dots in the sub-scanning direction. For example, it may be set to a size two times the pitch between dots in the main scanning direction or the pitch between dots in the sub-scanning direction, or it may be set to a multiple of the size of the dot 160 that would have been formed originally.

Next, another embodiment of the present invention will be described.

Figure 13A:
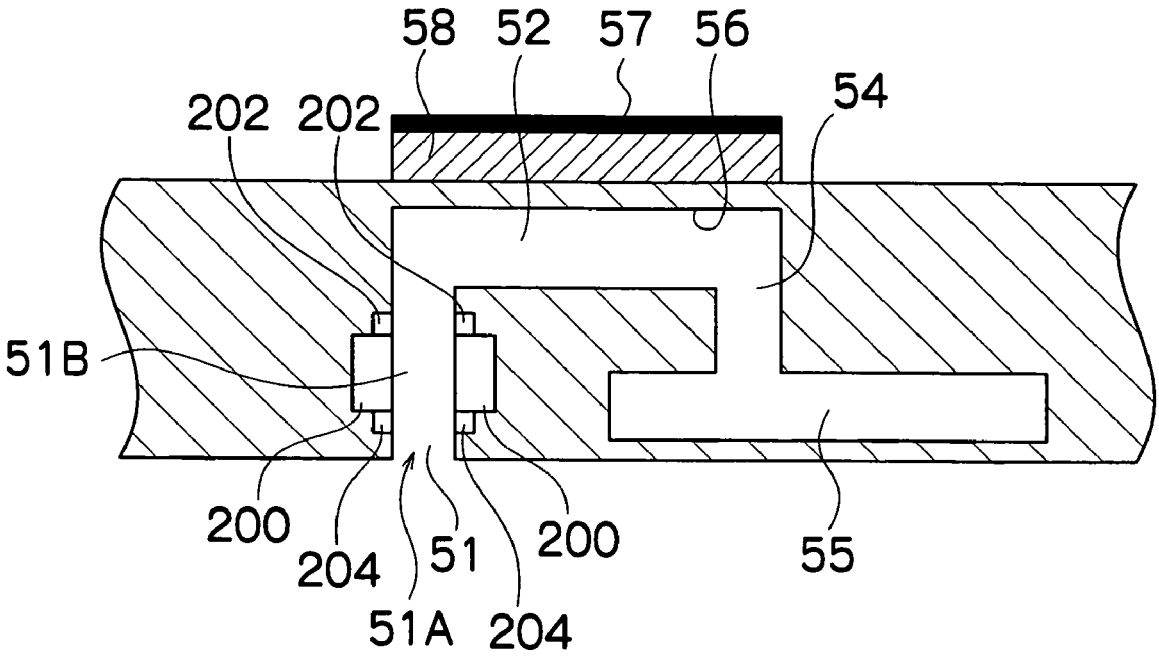
FIGS. 13A and 13B are diagrams showing a modification of the ink chamber unit illustrated in FIG. 4.
Figure 13B:
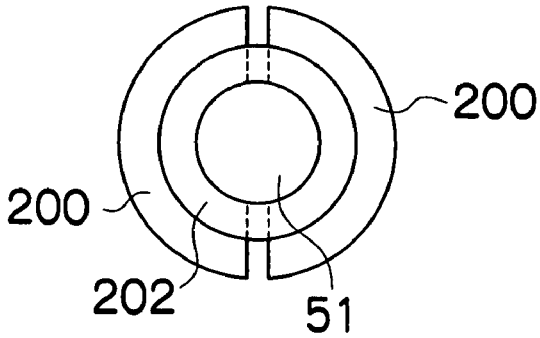

FIG. 13A is a cross-sectional diagram of an ink chamber unit according to the present embodiment, and FIG. 13B is a plan view perspective diagram as viewed from a nozzle opening section 51A in FIG. 13A. In FIG. 13A, items that are the same as or similar to those in FIG. 4 are denoted with the same reference numerals and description thereof is omitted here.

As shown in FIG. 13A, a heater 200 is arranged around the nozzle passage 51B of the nozzle 51. Furthermore, a heat sensor 202 is arranged at a side of the heater 200 facing to the pressure chamber 52, and a heat sensor 204 is arranged at the other side of the heater 200 facing to the nozzle opening section 51A. It is also possible to provide only one of the heat sensor 202 and the heat sensor 204, or to provide a temperature sensor instead of the heat sensor 202 and/or the heat sensor 204.

The heater 200 has a structure that is split into two parts in the circumferential direction and is disposed about a circumference so as to surround the perimeter of the nozzle passage 51B as shown in FIG. 13B. The heater 200 is not limited to being split into two parts and it may also be split into a greater number of parts.

When heat is applied to the ink inside the nozzle passage 51B by means of the heater 200, a thermal distribution (thermal gradient) is generated between the ink before and after the heater 200. By determining this thermal distribution by means of the heat sensor 202 and the heat sensor 204, the flow speed of the ink inside the nozzle passage 51B is measured. If the ink flow speed is less than a prescribed value, then the nozzle is considered to be suffering an ejection abnormality. It is thus judged whether or not a normal ejection can be performed using that nozzle.

If a nozzle having an ejection abnormality is detected, then a compensatory nozzle is selected in place of the nozzle having the ejection abnormality, in order to eject an ink droplet to form a dot that would originally have been formed by an ink droplet ejected from the abnormal nozzle. A compensatory ejection is performed using this compensatory nozzle.

In compensatory ejection, heat is applied to the ink inside the nozzle passage 51B by using the heater 200 arranged in the nozzle passage 51B of the selected compensatory nozzle. By heating the ink in this way, a distribution in the ink viscosity is generated and hence a distribution in the flow speed of the ink inside the nozzle passage 51B can also be generated. By generating the distribution in the ink flow speed, it is possible to control the direction of flight of the ink.

If the direction of flight of the ink is to be deflected in a prescribed direction, then it is possible to position the heater 200 in accordance with this direction of deflection. Alternatively, heaters may be provided in a split fashion around the nozzle passage 51B and the direction of flight of the ink may be deflected by selectively switching and controlling the on/off operation of the split heaters.

As described above, the heater 200, the heat sensor 202 and the heat sensor 204 are provided at each nozzle in order to detect ejection abnormalities from the flow speed of the ink. The ink flow speed is measured by determining the thermal distribution in the ink by means of the heat sensor 202 and the heat sensor 204, and an ejection abnormality is detected according to the ink flow speed thus determined.

The heat sensor may be one which determines the temperature of the ink directly, such as a thermocouple, or it may be a non-contact type of sensor.

The ink flow speed measurement described above is just one example and other methods apart from this may be adopted. Either one of the heat sensor 202 or the heat sensor 204 may be omitted, depending on the flow speed measurement method used.

If a nozzle having an ejection abnormality is detected, then a compensatory nozzle for performing a compensatory ejection is selected from the nozzles adjacent to the nozzle having the abnormality. Heat is applied to the ink inside the nozzle passage 51B by the heater 200 provided in the compensatory nozzle. Accordingly, a distribution is generated in the flow speed of the ink inside the nozzle passage 51B, and hence the direction of flight of the ejected ink can be deflected.

Since ejection abnormalities can be determined and the flight of the ink droplets can be controlled by means of this composition, it is possible to provide compensation for nozzles having an ejection abnormality.

For the device for deflecting the direction of flight of the ink droplets as described above, it is possible to provide a plurality of actuators for ejecting ink droplets in each ink chamber unit, the direction of flight of the ink droplets being controlled by controlling this plurality of actuators.

If ink droplets are deposited onto a plurality of deposition positions from one nozzle by deflecting the direction of flight of the ink droplets as described in the present embodiment, then it is possible to achieve high-density recording of pixels by using a print head having a low nozzle density.

The above-described embodiments are related to an inkjet recording apparatus in which images are formed on a recording medium by means of ink droplets ejected from a print head; however, the present invention may also be applied to a liquid ejection device which ejects water, a chemical, a processing liquid, or the like, onto an ejection receiving medium, such as paper, a substrate, a metal plate, and a semiconductor or silicon wafer.

In the present specification, the term "printing" indicates the concept of forming images in a broad sense, including text, and not simply the formation of text.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection device, comprising:

an ejection head including a plurality of nozzles which eject droplets of liquid onto an ejection receiving medium;

a liquid flow speed determining device which determines a flow speed of the liquid in each of the nozzles, the liquid flow speed determining device being arranged in each of the nozzles;

an ejection abnormality detecting device which detects an ejection abnormality in each of the nozzles according to the flow speed of the liquid determined by the liquid flow speed determining device;

an ejection direction deflecting device which deflects a direction of ejection of a droplet of the liquid ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the liquid ejected from one of the nozzles adjacent to the abnormal nozzle, by means of the ejection direction deflecting device.

2. The liquid ejection device as defined in claim 1, further comprising:

a movement device which moves at least one of the ejection receiving medium and the ejection head to move the ejection receiving medium and the ejection head relatively to each other in a relative movement direction, wherein the ejection compensation control device implements control in such a manner that, if the abnormal nozzle is detected by the ejection abnormality detecting device when ejecting droplets in a first main scanning line, a compensatory ejection is performed by using the one of the nozzles adjacent to the abnormal nozzle, when ejecting droplets in a second or subsequent main scanning line that are ejected after the first main scanning line.

3. The liquid ejection device as defined in claim 2, wherein:

the ejection head includes a full line ejection head having nozzle rows arranged two-dimensionally and of a length corresponding to a full dimension of a receivable width on the ejection receiving medium; and the ejection compensation control device implements control in such a manner that, if the abnormal nozzle is detected by the ejection abnormality detecting device, a compensatory ejection is performed by deflecting the direction of ejection of the droplet of the liquid ejected from the one of the nozzles adjacent to the abnormal nozzle disposed on a downstream side of the abnormal nozzle in the relative movement direction of the ejection receiving medium, the direction of ejection being deflected in a direction substantially perpendicular to the relative movement direction of the ejection receiving medium.

4. The liquid ejection device as defined in claim 1, wherein the ejection abnormality detecting device detects an ejection abnormality in each of the nozzles during an operation of retracting a meniscus of the liquid inside each of the nozzles.

5. The liquid ejection device as defined in claim 1, wherein the ejection compensation control device implements control in such a manner that a volume of liquid ejected in the compensatory ejection is substantially equal to a volume of liquid that would originally have been ejected from the abnormal nozzle.

6. A liquid ejection device, comprising:

an ejection head including a plurality of nozzles which eject droplets of electrostatically charged liquid onto an ejection receiving medium;

a liquid flow speed change determining device which determines a change in a flow speed of the charged liquid inside each of the nozzles from an electrical signal generated according to the change in the flow speed of the charged liquid inside each of the nozzles, the liquid flow speed change determining device being arranged in each of the nozzles;

an ejection abnormality detecting device which detects an ejection abnormality in each of the nozzles according to the electrical signal obtained from the liquid flow speed change determining device;

an ejection direction deflecting device which deflects a direction of ejection of a droplet of the liquid ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the charged liquid ejected from one of the nozzles adjacent to the abnormal nozzle, by means of the ejection direction deflecting device.

7. The liquid ejection device as defined in claim 6, further comprising a charging device which electrostatically charges the liquid supplied to the nozzles.

8. The liquid ejection device as defined in claim 6, further comprising:

a movement device which moves at least one of the ejection receiving medium and the ejection head to move the ejection receiving medium and the ejection head relatively to each other in a relative movement direction, wherein the ejection compensation control device implements control in such a manner that, if the abnormal nozzle is detected by the ejection abnormality detecting device when ejecting droplets in a first main scanning line, a compensatory ejection is performed by using the one of the nozzles adjacent to the abnormal nozzle, when ejecting droplets in a second or subsequent main scanning line that are ejected after the first main scanning line.

9. The liquid ejection device as defined in claim 8, wherein:

the ejection head includes a full line ejection head having nozzle rows arranged two-dimensionally and of a length corresponding to a full dimension of a receivable width on the ejection receiving medium; and the ejection compensation control device implements control in such a manner that, if the abnormal nozzle is detected by the ejection abnormality detecting device, a compensatory ejection is performed by deflecting the direction of ejection of the droplet of the liquid ejected from the one of the nozzles adjacent to the abnormal nozzle disposed on a downstream side of the abnormal nozzle in the relative movement direction of the ejection receiving medium, the direction of ejection being deflected in a direction substantially perpendicular to the relative movement direction of the ejection receiving medium.

10. The liquid ejection device as defined in claim 6, wherein the ejection abnormality detecting device detects an ejection abnormality in each of the nozzles during an operation of retracting a meniscus of the liquid inside each of the nozzles.

11. The liquid ejection device as defined in claim 6, wherein the ejection compensation control device implements control in such a manner that a volume of liquid ejected in the compensatory ejection is substantially equal to a volume of liquid that would originally have been ejected from the abnormal nozzle.

12. A liquid ejection device, comprising:

an ejection head including a plurality of nozzles which eject droplets of liquid onto an ejection receiving medium;

a temperature altering device which produces a temperature gradient in a circumferential direction of each of the nozzles to the liquid inside each of the nozzles by selectively applying heat to the liquid, the temperature altering device being arranged in each of the nozzles around a perimeter of each of the nozzles and being divided in the circumferential direction of each of the nozzles;

a temperature determining device which determines temperature of the liquid inside each of the nozzles, the temperature determining device being arranged in each of the nozzles on at least one of an upstream side and a downstream side of the temperature altering device in a direction of flow of the liquid;

an ejection abnormality detecting device which detects an ejection abnormality in each of the nozzles according to the temperature of the liquid determined by the temperature determining device;

an ejection compensation control device which performs control in such a manner that, when an abnormal one of the nozzles having an ejection abnormality is detected by the ejection abnormality detecting device, a compensatory ejection is performed by deflecting a direction of ejection of a droplet of the liquid ejected from one of the nozzles adjacent to the abnormal nozzle, by means of the temperature altering device.

13. The liquid ejection device as defined in claim 12, further comprising:

a movement device which moves at least one of the ejection receiving medium and the ejection head to move the ejection receiving medium and the ejection head relatively to each other in a relative movement direction, wherein the ejection compensation control device implements control in such a manner that, if the abnormal nozzle is detected by the ejection abnormality detecting device when ejecting droplets in a first main scanning line, a compensatory ejection is performed by using the one of the nozzles adjacent to the abnormal nozzle, when ejecting droplets in a second or subsequent main scanning line that are ejected after the first main scanning line.

14. The liquid ejection device as defined in claim 13, wherein:

the ejection head includes a full line ejection head having nozzle rows arranged two-dimensionally and of a length corresponding to a full dimension of a receivable width on the ejection receiving medium; and the ejection compensation control device implements control in such a manner that, if the abnormal nozzle is detected by the ejection abnormality detecting device, a compensatory ejection is performed by deflecting the direction of ejection of the droplet of the liquid ejected from the one of the nozzles adjacent to the abnormal nozzle disposed on a downstream side of the abnormal nozzle in the relative movement direction of the ejection receiving medium, the direction of ejection being deflected in a direction substantially perpendicular to the relative movement direction of the ejection receiving medium.

15. The liquid ejection device as defined in claim 12, wherein the ejection compensation control device implements control in such a manner that a volume of liquid ejected in the compensatory ejection is substantially equal to a volume of liquid that would originally have been ejected from the abnormal nozzle.

16. An image forming apparatus, comprising:

a recording head having a plurality of nozzles which eject droplets of ink onto an ejection receiving medium;

an ink flow speed determining device which determines a flow speed of the ink in each of the nozzles, the ink flow speed determining device being arranged in each of the nozzles;

an ejection abnormality detecting device which detects an ejection abnormality in each of the nozzles according to the flow speed of the ink determined by the ink flow speed determining device;

an ejection direction deflecting device which deflects a direction of ejection of a droplet of the ink ejected from each of the nozzles, the ejection direction deflecting device being arranged in each of the nozzles; and an ejection compensation control device which performs control in such a manner that, when an abnormal one of the nozzles having an ejection abnormality is detected by the ejection abnormality detecting device, a compensatory ejection is performed by deflecting a direction of ejection of a droplet of the ink ejected from one of the nozzles adjacent to the abnormal nozzle, by means of the ejection direction deflecting device.

* * * * *